US010199032B2

(12) United States Patent
Jin et al.

(10) Patent No.: US 10,199,032 B2
(45) Date of Patent: Feb. 5, 2019

(54) ADAPTIVE REVERBERATION CANCELLATION SYSTEM

(71) Applicant: Huawei Technologies Co., Ltd., Shenzhen (CN)

(72) Inventors: Wenyu Jin, Munich (DE); Peter Grosche, Munich (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/952,864

(22) Filed: Apr. 13, 2018

(65) Prior Publication Data

US 2018/0233123 A1 Aug. 16, 2018

Related U.S. Application Data

(63) Continuation of application No. PCT/EP2015/073818, filed on Oct. 14, 2015.

(51) Int. Cl.
*G10K 11/178* (2006.01)
*G10L 21/0232* (2013.01)
*G10L 21/0208* (2013.01)

(52) U.S. Cl.
CPC ..... *G10K 11/178* (2013.01); *G10L 21/0232* (2013.01); *G10K 2210/12* (2013.01);
(Continued)

(58) Field of Classification Search
CPC ..... H04S 7/00; H04S 3/02; H04S 3/04; H04S 7/301; H04S 7/50; H04S 2420/01; G10L 21/0208
(Continued)

(56) References Cited

U.S. PATENT DOCUMENTS

2011/0268283 A1* 11/2011 Nakadai ..... H04R 3/04 381/56
2015/0195644 A1* 7/2015 Wilson ..... H04R 1/40 381/92

FOREIGN PATENT DOCUMENTS

WO 2015062658 A1 5/2015

OTHER PUBLICATIONS

Betlehem, T., et al., "Theory and design of sound field reproduction in reverberant rooms," J. Acoust. Soc. Am. 117 (4), Pt. 1, Apr. 2005, 12 pages.

(Continued)

*Primary Examiner* — Melur Ramakrishnaiah
(74) *Attorney, Agent, or Firm* — Conley Rose, P.C.

(57) ABSTRACT

A signal processor for determining a plurality of drive signals for driving a plurality of loudspeakers to cancel a reverberation effect in a listening area, wherein the signal processor is configured to determine from one or more measured audio signals a plurality of measured physical coefficients in a basis of physical sound functions, such that a sum of the physical sound functions, weighted with the plurality of measured physical coefficients approximates the one or more measured audio signals, wherein at least half of the plurality of measured physical coefficients are zero, determine a residual error between the plurality of measured physical coefficients and a plurality of desired physical coefficients, estimate a transfer function describing a transformation from the plurality of desired physical coefficients to the plurality of measured physical coefficients, based on the determined residual error, and update the plurality of drive signals based on the estimated transfer function.

19 Claims, 5 Drawing Sheets

(52) U.S. Cl.
CPC ..... *G10K 2210/3028* (2013.01); *G10L 2021/02082* (2013.01)

(58) Field of Classification Search
USPC ..... 381/56, 66
See application file for complete search history.

(56) References Cited

OTHER PUBLICATIONS

Brannmark, L., et al., "Improved Loudspeaker-Room Equalization using Multiple Loudspeakers and MIMO Feedforward Control," XP032227105, IEEE International Conference on Acoustics, Speech and Signal Processing, Mar. 25-30, 2012, pp. 237-240.
Buchner, H., "A General Derivation of Wave-Domain Adaptive Filtering and Application to Acoustic Echo Cancellation," in Signals, Systems and Computers, 2008 42nd Asilomar Conference on, Oct. 2008, 8 pages.
Buchner, H., et al., "Wave-Domain Adaptive Filtering: Acoustic Echo Cancellation for Full-Duplex Systems Based Onwave-Field Synthesis," IEEE International Conference on Acoustics, Speech, and Signal Processing, May 17-21, 2004, 4 pages.
Chartrand, R., "Exact Reconstruction of Sparse Signals via Nonconvex Minimization," IEEE Signal Processing Letters, vol. 14, No. 10, Oct. 2007, pp. 707-710.
Delcroix, M., et al., "Dereverberation and Denoising Using Multichannel Linear Prediction," XP011187707, IEEE Transactions on Audio, Speech and Language Processing, vol. 15, No. 6, Aug. 1, 2007, pp. 1791-1801.
Jin, W., et al., "Multizone Soundfield Reproduction in Reverberant Rooms Using Compressed Sensing Techniques," IEEE International Conference on Acoustic, Speech and Signal Processing (ICASSP), 2014, 5 pages.
Jin, W., et al., "Multizone Soundfield Reproduction Using Orthogonal Basis Expansion," IEEE International Conference on Acoustics Speech and Signal Processing, 2013, pp. 311-315.
Poletti, M., "Sound-field reproduction systems using fixed-directivity loudspeakers," J. Acoust. Soc. Am., vol. 127 No. 6, Acoustical Society of America, Jun. 2010, pp. 3590-3601.
Schneider, M., "Adaptive listening room equalization using a scalable filtering structure in the wave domain," IEEE International Conference on Acoustics, Speech and Signal Processing (ICASSP), Mar. 2012, pp. 13-16.
Spors, S., et al., "Active listening room compensation for massive multichannel sound reproduction systems using wave-domain adaptive filtering," XP012102317, The Journal of the Acoustical Society of America, American Institute of Physics for the Acoustical Society of America, vol. 122, No. 1, Jul. 1, 2007, 16 pages.
Talagala, D., et al., Efficient Multi-Channel Adaptive Room Compensation for Spatial Soundfield Reproduction Using a Modal Decomposition. IEEE/ACM Transactions on Audio, Speech, and Language Processing, vol. 22, No. 10, Oct. 2014, pp. 1522-1532.
Foreign Communication From a Counterpart Application, PCT Application No. PCT/EP2015/073818, English Translation of International Search Report dated Jul. 27, 2016, 6 pages.
Foreign Communication From a Counterpart Application, PCT Application No. PCT/EP2015/073818, English Translation of Written Opinion dated Jul. 27, 2016, 5 pages.

* cited by examiner

ADAPTIVE REVERBERATION CANCELLATION SYSTEM

CROSS-REFERENCE TO RELATED APPLICATIONS

This application is a continuation of International Application No. PCT/EP2015/073818, filed on Oct. 14, 2015, the disclosure of which is hereby incorporated by reference in its entirety.

TECHNICAL FIELD

The present disclosure relates to a signal processor, a sound device, and a method for generating a plurality of drive signals for driving a plurality of loudspeakers to cancel a reverberation effect in a listening area. The present disclosure also relates to a computer-readable storage medium.

BACKGROUND

Reproduction of a desired multi zone sound field over a region of interest has drawn the attention of researchers in recent years. However, the majority of existing works in this area do not take into account the reverberant environments that practical multi zone sound reproduction systems will encounter. The reverberation compensation process is difficult to handle due to the unknown reverberant room channel and the large number of loudspeakers and microphones required by existing sound field reproduction systems.

Reverberation is the collection of reflected sounds from the surfaces in an enclosure. It is created when a sound or signal is reflected in an enclosed environment that leads to a large number of reflections and then gradually decay as the sound is absorbed by walls, scatterers and air. This is most noticeable when the sound source stops but the reflections continue to exist till they reach zero amplitude. The majority of the sound field reproduction techniques are designed with free-field assumption, but this is not the case in most real implementations.

Room reverberation poses a major challenge in sound field reproduction and the unwanted reverberation generally leads to poor sound field reproduction and localization confusion for the listeners. Therefore, reverberation cancelation techniques are indispensable for a reproduction system with real-world settings. The most natural approaches are the passive techniques. For example, the room can be equipped with acoustic absorption materials, so that a modest attenuation of sound reflection is provided. However, the related costs pose a major challenge for this method and it is difficult to realize in many real-world application scenarios (e.g., sound field reproduction in an office or home environment). More technically advanced passive approaches may use fixed or variable directivity higher order loudspeakers in order to minimize the sound radiation directing towards the walls of a room. However, it requires some specific sound reproduction apparatus, which is difficult to achieve in practice.

To equalize the room reverberation, the inverse of the room response is generally applied to loudspeaker driving signals. Techniques have been suggested that are based on mode matching to reproduce a single-zone sound field accurately over the entire control region in reverberant rooms. An approach of reproducing a multi zone sound field within a desired region using sparse methods was introduced. This allowed a reduced number of randomly placed measurements to sparsely estimate the room transfer functions from the loudspeakers over the desired region in the domain of plane wave decomposition. The estimates were then used to derive the optimal least-squares solution for the loudspeaker filter gains. For these approaches, a prior measurement of the room transfer function for all the employed loudspeakers was needed. This is time-consuming to implement in practice and its performance is vulnerable to any changes in the ambient environment conditions during the measurement process.

Wave Domain Adaptive Filtering (WDAF) is a more practical approach to the application of reverberation cancelation in sound field reproduction. It has been introduced to active listening room compensation in Wave Field Synthesis systems. The wave-domain representation of the sound field was described using transformations on the microphone array input and the loudspeaker output respectively. These techniques suffer from practical issues, e.g. a large number of microphones are required for the room channel estimation. Additionally, the adaptive processes in these techniques are shown to diverge in some reverberant environments that feature low direct-to-reverberant-path power ratios. The iterative calculation of the pseudoinverse in each iteration is needed, which may lead to ill-conditioning problems and channel estimation errors.

SUMMARY OF THE DISCLOSURE

The objective of the present disclosure is to provide a signal processor, a sound device, a method for generating a plurality of drive signals for driving a plurality of loudspeakers to cancel a reverberation effect in a listening area, wherein the signal processor, the sound device, and the method for generating a plurality of drive signals for driving a plurality of loudspeakers to cancel a reverberation effect in a listening areas overcome one or more of the above-mentioned problems of some approaches.

A first aspect of the disclosure provides a signal processor for determining a plurality of drive signals for driving a plurality of loudspeakers to cancel a reverberation effect in a listening area, wherein the signal processor is configured to determine from one or more measured audio signals a plurality of measured physical coefficients in a basis of physical sound functions, such that a sum of the physical sound functions, weighted with the plurality of measured physical coefficients approximates the one or more measured audio signals, wherein at least half of the plurality of measured physical coefficients are zero, determine a residual error between the plurality of measured physical coefficients and a plurality of desired physical coefficients, estimate a transfer function describing a transformation from the plurality of desired physical coefficients to the plurality of measured physical coefficients, based on the determined residual error, and update the plurality of drive signals based on the estimated transfer function, wherein the signal processor is configured to carry out the above steps once, or two or more times, e.g. to repeatedly carry out the above steps.

The necessity of a large number of loudspeaker-microphone channels for existing sound rendering systems complicates the application of multi zone sound field reproduction in reverberant environments. The signal processor of the first aspect provides an adaptive reverberation cancelation for multi zone sound field reproduction using sparse methods. The use of sparse methods results in a significantly reduced number of microphones for the estimation of the reproduced sound field. The signal processor also facilitates the system convergence over a wide frequency range in reverberant environments.

In embodiments of the disclosure, updating the plurality of drive signals comprises a step of computing an update filter, i.e., a set of update filter elements that reflect the reverberation cancellation.

Preferably, the signal processor is configured to carry out the above-mentioned steps repeatedly until the residual error is sufficiently small. e.g. smaller than a predetermined threshold.

Mathematically speaking, the signal processor of the first aspect can be configured to find a sparse vector b such that $\Phi b$ approximates the measured signal v, wherein $\Phi$ is a matrix with columns which comprise physical sound functions.

The signal processor of the first aspect can be used in a multi zone sound field reproduction system which comprises a circular array of Q loudspeakers and M microphones. The loudspeakers are placed outside the desired reproduction region and the microphones can be randomly placed within the selected zones of interest. The proposed system can be, for example, applied to teleconference systems and car audio systems, in which a circular or linear loudspeaker array is employed and the microphones are freely distributed around the listeners. The adaptive reverberation cancelation system aims to rectify the reverberation effects based on iterative feedback from sparse microphone measurements and to actively play back the input signals via the loudspeaker array with updated FIR gain filters.

Let $l_q(t)$ be the driving signal for the q-th loudspeaker and $v_m(t)$ be the recorded signal of the m-th microphone measurement. Taking the Fourier transform, the received measurements at the microphones can be expressed in matrix form as $$v(k)=C(k)\mathrm{I}(k), \tag{1}$$

where $\mathrm{I}(k)=[l_1(k), \ldots, l_Q(k)]^T$ are the loudspeaker driving signals, $v(k)=[v_1(k), \ldots, v_M(k)]^T$ are the microphone measurements, and C(k) represents the channel between the (m, q)-th microphone-loudspeaker pair at the frequency k. The channel effects C(k) may be separated into the direct and reverberant path, $C(k)=C_d(k)+C_r(k)$, where $C_d(k)$ and $C_r(k)$ represent the direct and reverberant channels between the (m,q)-th microphone-loudspeaker pair.

In a preferred embodiment, an orthonormal set of basis functions $\{G_n\}$ is used, which describes any physically feasible sound field by implementing a modified Gram-Schmidt process on plane wave functions arriving from various angles. Therefore, the measurements in (1) may be expressed as:

$$v_m(k) = \sum_{n=1}^{N} b_n(k)G_n(x_m, k), \tag{2}$$

where $b_n(k)$ are the coefficients for the reproduced sound field and $x_m$ represents the m-th microphone location. Note that N is set to be sufficiently large.

The plurality of measured physical coefficients can be seen as a sparse approximation, i.e., a sparse vector y that approximately solves an under-determined linear system of equations. The measurements in v are the products of rows of the sensing matrix $\Phi$ and the sparse signal y. To provide an accurate and stable estimate of y from the insufficient observation v, when y is sufficiently sparse, it is advantageous if the observation value is the linear projection of the sparse signal onto an incoherent basis. A proposed formulation is consistent with this requirement that the random samplings of the sound pressure field in v are incoherent with the original basis of y.

In a first implementation of the signal processor according to the first aspect, the processor is further configured to, when determining the plurality of measured physical coefficients, minimize an error measure between the measured audio signals and a linear transformation of the measured physical coefficients, and minimize a number of non-zero entries of the plurality of measured physical coefficients.

The linear transformation can be a sensing matrix. i.e., it can comprise in its columns the basis function vectors of the basis of physical sound functions.

By simultaneously minimizing the error measure and minimizing the number of non-zero entries of the plurality of measured physical coefficients, it is ensured that the measurements are processed as accurately as possible, while still obtaining a sparse vector b of the plurality of measured physical coefficients, which can easily be processed.

In a second implementation of the signal processor according to the first aspect, the signal processor is further configured to, when minimizing the error measure and minimizing the number of non-zero entries of the plurality of measured physical coefficients, determining a vector b of the plurality of measured physical coefficients according to:

$$b=\mathrm{argmin}_y\|y\|_p^p, \text{ such that } \|v-\Phi y\|^2\leq\in \text{ for } 0\leq p\leq 1,$$

wherein $\|y\|_p$ is a p-norm of a vector y, $\Phi$ is a M×N sensing matrix comprising columns with the physical sound functions, N»M, v is an M×1 observation vector which comprises the one or more measured audio signals corresponding to M locations within the listening area, wherein in particular the M locations are chosen randomly.

The sensing matrix $\Phi$ in an embodiment is an M×N sensing matrix whose columns preferably contain the values of the basis functions $G_n(x; k)$ at M microphone locations.

The signal processor may comprise an input for obtaining information on the M locations, i.e. the locations can be random, but known or approximately known to the signal processor.

This represents a particular efficient way of computing the plurality of measured physical coefficients.

In a third implementation of the signal processor according to the first aspect, the basis of physical sound functions is orthogonal with regard to an inner product that for a first vector $b_i$ and a second vector $b_j$ is representable as:

$$\langle b_i|b_j\rangle=\int_R b_i(x)b_j(x)w(x)dx=\sigma_{ij}$$

wherein R is a reproduction region of the plurality of loudspeakers, w(x) is a weighting function and $\sigma_{ij}$ is 1 for i=j and 0 otherwise.

In other words, the basis of physical sound functions can be chosen to be orthogonal with regard to an inner product that is defined as an integral over the reproduction region, e.g. an area between the plurality of loudspeakers.

In a fourth implementation of the signal processor according to the first aspect, the basis of physical sound functions comprises an orthonormal set of physical sound functions obtained from a modified Gram-Schmidt process on plane wave functions corresponding to a plurality of angles.

This has the advantage that the basis of physical sound functions can be used to describe any feasible sound field and match the desired sound f field in a weighted least-square sense.

In a fifth implementation of the signal processor according to the first aspect the transfer function assigns a zero-coupling between a first and a second coefficient of the basis of physical sound functions, in particular wherein the transfer function is representable as a diagonal matrix U(k).

Assuming a zero-coupling of the transfer function between different coefficients of the basis of physical sound functions has the advantage that the computation is simplified. In particular, a diagonal representation of the transfer function as a diagonal matrix U(k) leads to a significant simplification of the computation.

In a sixth implementation of the signal processor according to the first aspect, the signal processor is further configured to, when estimating the transfer function, estimating the diagonal matrix U(k) using a Least Mean Squares (LMS) filter and/or using a Recursive Least Squares (RLS) filter.

These represent efficient ways of computing the diagonal matrix.

In a seventh implementation of the signal processor according to the first aspect, the signal processor is further configured to, when estimating the diagonal matrix U(k), computing an n-th element of the diagonal matrix U(k) according to $$\hat{U}_n(k)_\tau^H = \hat{U}_n(k)_{\tau-1}^H + \frac{1}{\phi_n^2(\tau)} b_n^d(k)\left(\tilde{b}_n(k)_\tau - b_n^d(k)\right)^H,$$

where $\phi_n^2(\tau)$ is a gain factor, preferably defined as $\phi_n^2(\tau) = \lambda\phi_n^2(\tau-1) + |b_n^d(k)|^2$, $\lambda$ is a forgetting factor, $\hat{U}_n(k)_\tau^H$ is an n-th diagonal element of a $\tau$-th iteration of the diagonal matrix, $b_n^d(k)$ is an n-th element of the plurality of desired physical coefficients, and $\tilde{b}_n(k)_\tau$ is an n-th element of a $\tau$-th iteration of the plurality of measured physical coefficients.

This represents a particularly efficient way of iteratively computing the diagonal matrix U(k).

In an eighth implementation of the signal processor according to the first aspect, the signal processor is further configured to, when updating the drive signal, computing a drive signal update $\sigma^*$ such that an energy level of the drive signal update $\sigma^*$ is limited with an upper bound, wherein in particular the energy level of the drive signal update $\sigma^*$ is computed as a square value of $\sigma^*$.

Limiting an energy level of the drive signal update has the advantage that the process of updating the drive signal towards the desired optimal drive signal proceeds in small steps. Thus, undesired sound effects during the updating of the drive signal are avoided.

In a ninth implementation of the signal processor according to the first aspect the signal processor is further configured to, when updating the drive signal, computing the drive signal update $\sigma^*$ as $$\sigma^* = \underset{\sigma(k)}{\operatorname{argmin}} \left\| G^d(k)\sigma(k) - \left(I - \hat{U}(k)\right)b^d(k) \right\|^2$$

$$\text{s.t. } \|\sigma(k)_q\|^2 \le N_1 \quad q = 1 \ldots Q,$$

wherein $G^d(k)$ represents a pre-determined sound field coefficient matrix of Green's functions for the plurality of loudspeakers assuming a free-field propagation, I is an identity matrix, $\hat{U}(k)$ is an estimate of the diagonal matrix, and $N_1$ is a predetermined parameter, in particular $N_1 = (1-\beta(k)^2)/N_w$, wherein $\beta(k)$ is a reflection coefficient and $N_w$ is a number of walls of the listening area.

This represents an efficient way of implementing the updates of the drive signal. In particular, the above-defined iterative process makes use of the diagonal structure of the matrix U(k) and limits an energy level of the update of the drive signal.

In a tenth implementation of the signal processor according to the first aspect, the signal processor is further configured to perform an initial step of preconditioning the drive signal update $\sigma^*$ to 0 and/or preconditioning the diagonal matrix U(k) to an identity matrix.

The initial preconditioning steps have the advantage that the plurality of drive signals are initialized with a sensible starting point and the method implementation by the signal processor can thus converge faster towards the desired optimal solution.

In embodiments of the disclosure, the signal processor is configured to determine the drive signal update by determining an update filter. In this case, the update filter can be preconditioned to 0, i.e., the update filter is preconditioned as a zero update.

A second aspect of the disclosure refers to a sound device for generating a plurality of drive signals for driving a plurality of loudspeakers to cancel a reverberation effect in a listening area, the sound device comprising an output for driving the plurality of loudspeakers with the plurality of drive signals, an input for receiving one or more measured audio signals, and a signal processor according to the first aspect or one of its implementations, wherein the signal processor is configured to update the plurality of drive signals.

A third aspect of the disclosure refers to a method for generating a plurality of drive signals for driving a plurality of loudspeakers to cancel a reverberation effect in a listening area, the method comprising driving the plurality of loudspeakers with an initial plurality of drive signals, measuring one or more audio signals at one or more measurement locations, determining from the one or more measured audio signals a plurality of measured physical coefficients of in a basis of physical sound functions, such that a sum of the physical sound functions, weighted with the plurality of measured physical coefficients approximates the one or more measured audio signals, wherein at least half of the plurality of measured physical coefficients are zero, determining a residual error between the plurality of measured physical coefficients and a plurality of desired physical coefficients, estimating a transfer function from the plurality of measured physical coefficients and the plurality of desired physical coefficients, based on the determined residual error, and updating the initial plurality of drive signals based on the estimated transfer function, wherein the above steps are carried out once, or two or more times, e.g. repeatedly.

The methods according to the third aspect of the disclosure can be performed by the signal processor according to the first aspect of the disclosure. Further features or implementations of the method according to the third aspect of the disclosure can perform the functionality of the signal processor according to the first aspect of the disclosure and its different implementation forms.

In a first implementation of the method of the third aspect, minimizing the error measure and minimizing the number of non-zero entries of the plurality of measured physical coefficients comprises a step of determining a vector b of the plurality of measured physical coefficients according to:

$$b = \operatorname{argmin}_y \|y\|_p^P, \text{ such that } \|v - \Phi y\|^2 \le \in \text{ for } 0 \le p \le 1.$$

wherein $\|y\|_p$ is a p-norm of a vector y, $\Phi$ is a M×N sensing matrix comprising columns with the physical sound functions, N»M, v is an M×1 observation vector which comprises the one or more measured audio signals corresponding to M locations within the listening area, wherein in particular signal processor is configured to randomly chose the M locations.

A fourth aspect of the disclosure refers to a computer-readable storage medium storing program code, the program code comprising instructions for carrying out the method of the third aspect or one of its implementations.

BRIEF DESCRIPTION OF THE DRAWINGS

To illustrate the technical features of embodiments of the present disclosure more clearly, the accompanying drawings provided for describing the embodiments are introduced briefly in the following. The accompanying drawings in the following description are merely some embodiments of the present disclosure, but modifications on these embodiments are possible without departing from the scope of the present disclosure as defined in the claims.

DETAILED DESCRIPTION OF THE EMBODIMENTS

Figure 1:
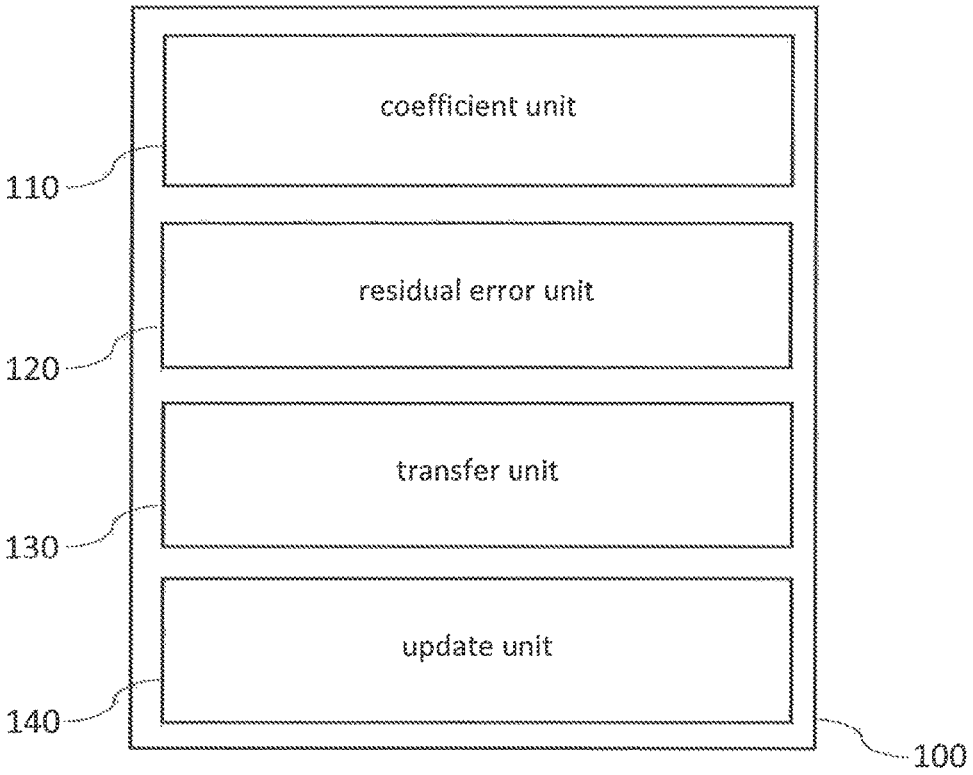
FIG. 1 shows a signal processor in accordance with an embodiment of the present disclosure.

FIG. 1 shows a signal processor 100 for determining a plurality of drive signals for driving a plurality of loudspeakers to cancel a reverberation effect in a listening area.

The signal processor 100 comprises a coefficient unit 110 which is configured to determine from one or more measured audio signals a plurality of measured physical coefficients in a basis of physical sound functions, such that a sum of the physical sound functions, weighted with the plurality of measured physical coefficients approximates the one or more measured audio signals, wherein at least half of the plurality of measured physical coefficients are zero. The basis of physical sound functions can be fixed or there can be several bases of physical sound functions, wherein a specific basis can be chosen, e.g. by setting a basis selection parameter.

The signal processor 100 further comprises a residual error unit 120 which is configured to determine a residual error between the plurality of measured physical coefficients and a plurality of desired physical coefficients.

The signal processor 100 further comprises a transfer unit 130, which is configured to estimate a transfer function describing a transformation from the plurality of desired physical coefficients to the plurality of measured physical coefficients, based on the determined residual error.

The signal processor 100 further comprises an update unit 140 which is configured to update the plurality of drive signals based on the estimated transfer function. The update unit 140 can be configured to generate an initial update as zero, i.e., to initially generate a drive signal that corresponds to an input signal. The input signal can be provided to the signal processor 100 from an external unit or the input signal can be determined in the signal processor 100.

The signal processor 100 is configured to control its units such that they repeatedly compute updates to the plurality of drive signals.

The coefficient unit 110, residual error unit 120, transfer unit 130 and the update unit 140 can be realized in the same physical hardware, for example they can be realized as different parts of a programming of the signal processor 100.

Figure 2:
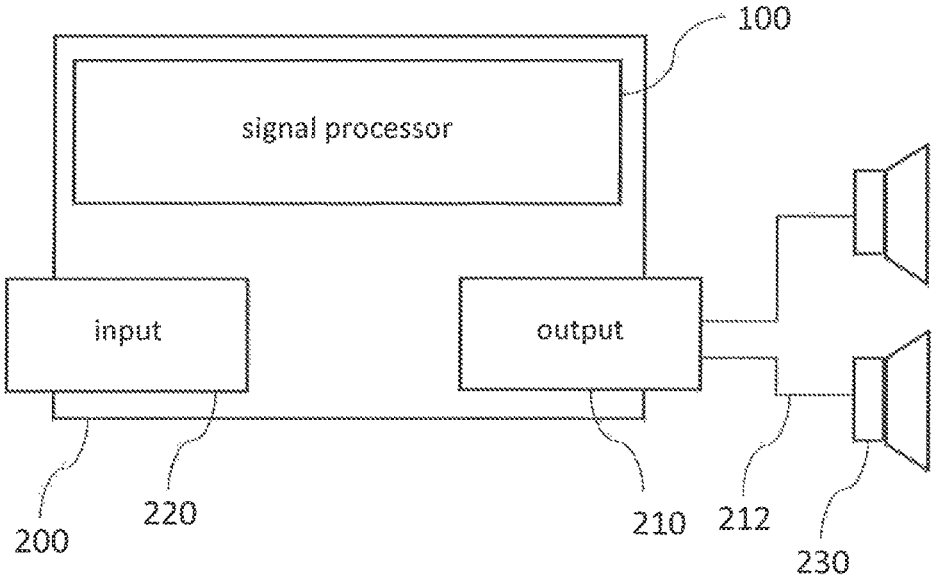
FIG. 2 shows a sound device in accordance with a further embodiment of the present disclosure.

FIG. 2 shows a sound device 200 for generating a plurality of drive signals for driving a plurality of loudspeakers to cancel a reverberation effect in a listening area. The sound device 200 comprises an output 210 for driving the plurality of loudspeakers with the plurality of drive signals 212, an input 220 for receiving one or more measured audio signals, and a signal processor 230. e.g. the signal processor of FIG. 1, configured to update the plurality of drive signals.

Figure 3:
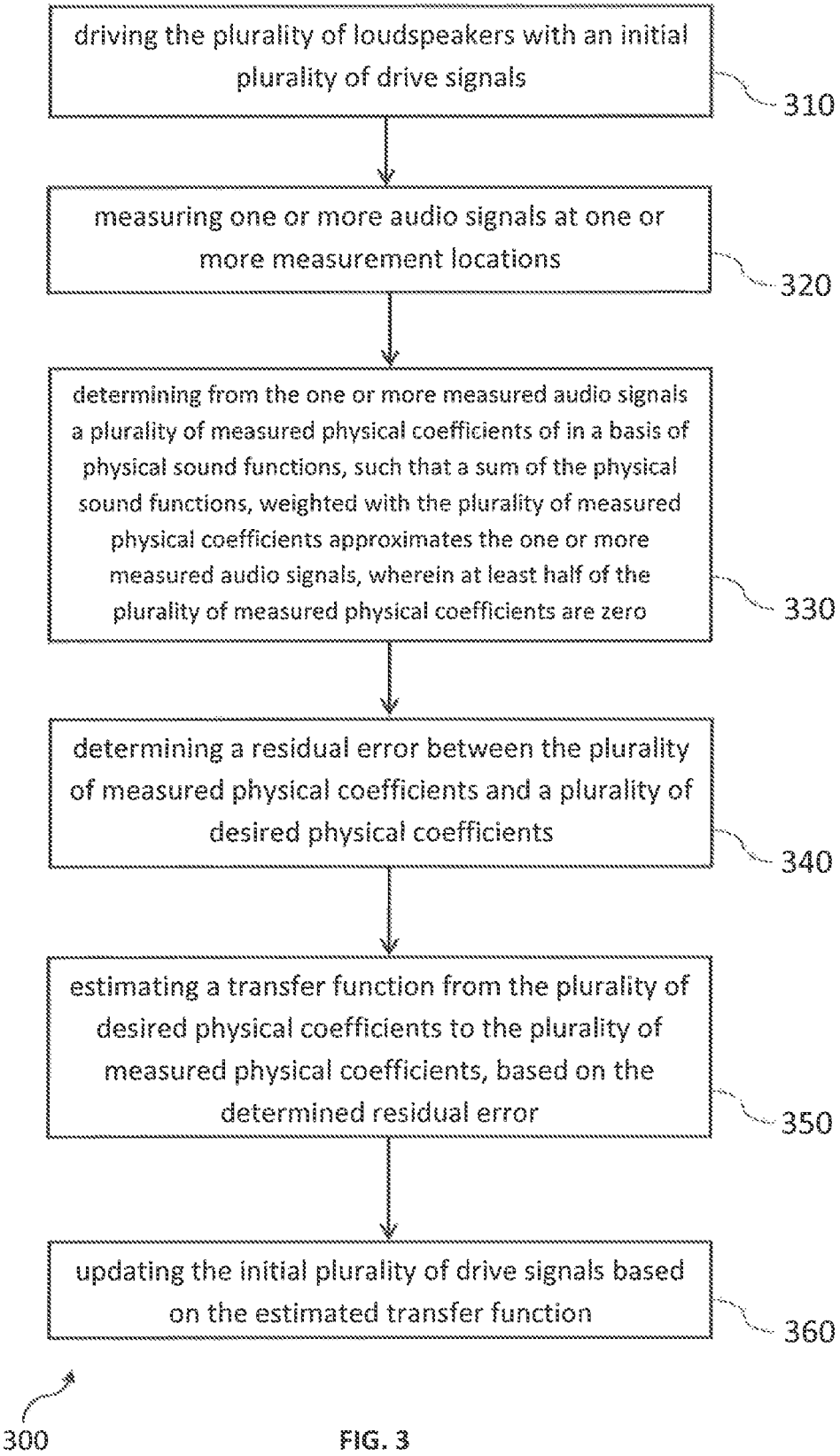
FIG. 3 shows a flowchart of a method for reverberation cancellation in accordance with a further embodiment of the present disclosure.

FIG. 3 shows a flow chart of a method 300 for generating a plurality of drive signals for driving a plurality of loudspeakers to cancel a reverberation effect in a listening area. The method comprises a first step of driving 310 the plurality of loudspeakers with an initial plurality of drive signals.

The method comprises a second step of measuring 320 one or more audio signals at one or more measurement locations. For example, the one or more audio signals can be measured using microphones that are placed at random locations in the listening area. The method can comprise a further step of determining positions of the randomly placed microphones, such that measured audio signals can be correlated with positions of the corresponding microphones.

In a third step 330 from the one or more measured audio signals a plurality of measured physical coefficients in a basis of physical sound functions is determined, such that a sum of the physical sound functions, weighted with the plurality of measured physical coefficients approximates the one or more measured audio signals, wherein at least half of the plurality of measured physical coefficients are zero. In particular, at least ¾ or preferably at least 90% of the plurality of measured physical coefficients can be zero.

In a fourth step 340 a residual error between the plurality of measured physical coefficients and a plurality of desired physical coefficients is determined.

In a fifth step 350 a transfer function describing a transformation from the plurality of desired physical coefficients to the plurality of measured physical coefficients is determined based on the determined residual error.

In a sixth step 360, an updated version of the initial plurality of drive signals is determined based on the estimated transfer function. The updated version of the initial plurality of drive signal is output to a plurality of loudspeakers, and the method can continue in step 320.

In a further step (not shown in FIG. 3), it can be determined whether the residual error is smaller than a predetermined threshold error. If it is smaller, the updated drive signal can be output and no further iterations of the method are performed. If the residual error is larger than the predetermined threshold, execution of the method continues with the first step, wherein the plurality of loudspeakers is now driven with the updated plurality of drive signals instead of the initial plurality of drive signals.

Figure 4:
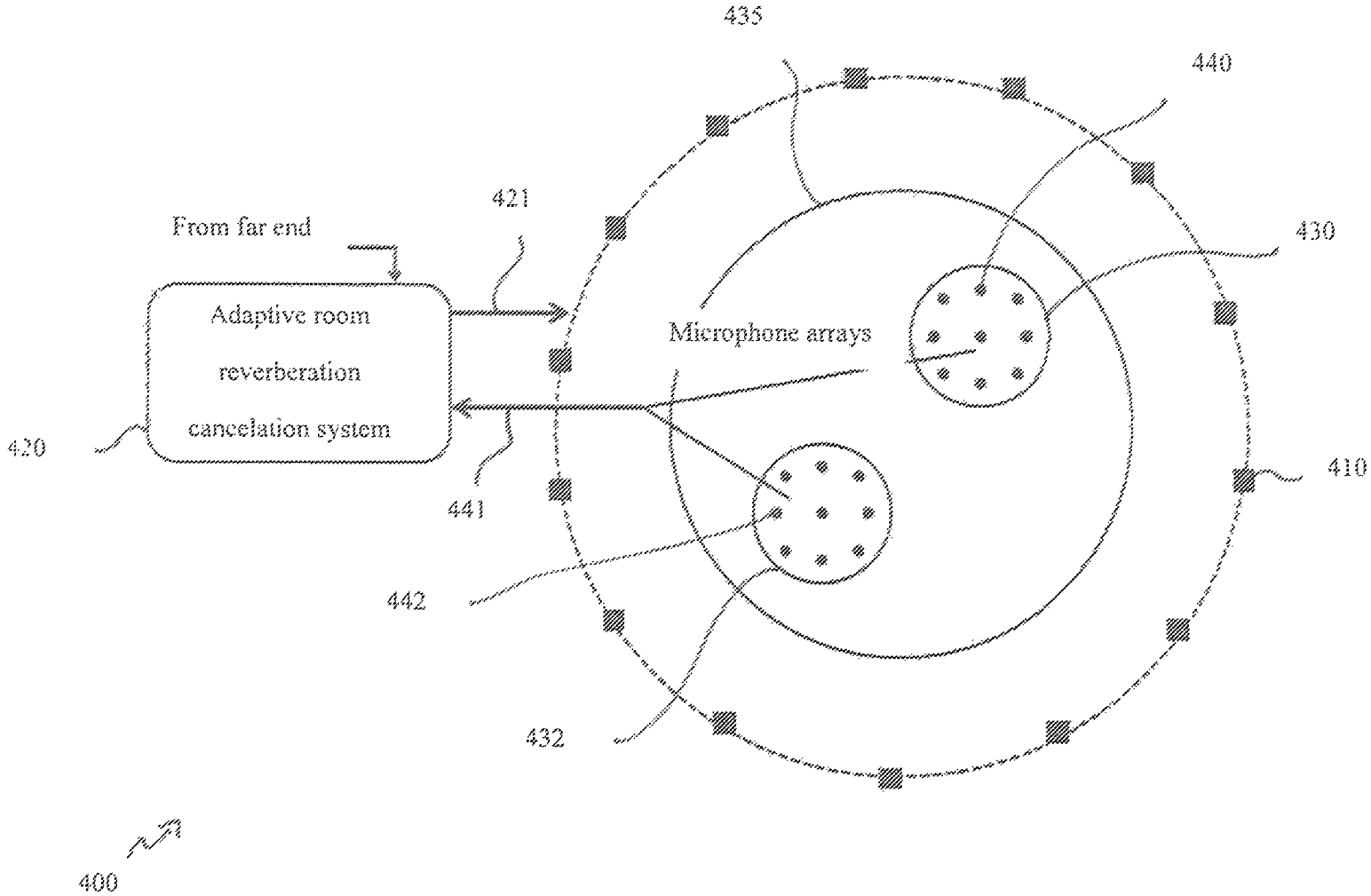
FIG. 4 shows a structure of a multi zone sound field reproduction system in accordance with a further embodiment of the present disclosure.

FIG. 4 shows a structure of a multi zone sound field reproduction system 400 in accordance with a further embodiment of the present disclosure. The multi zone sound field reproduction system 400 comprises an adaptive room reverberation cancelation system 420, an array of loudspeakers 410, a first microphone array 440 that is located in a first listening zone 430 and a second microphone array 442 that is located in a second listening zone 432. The array of loudspeakers defines a listening area 435 that comprises the first and second listening zone 430, 432.

The adaptive room reverberation cancelation system 420 comprises a sound device, e.g. the sound device of FIG. 2, with an input, output and a signal processor. The input is configured to receive audio signals 441 from the first and second microphone array 440, 442. The output is configured to drive the array of loudspeakers 410 with drive signals 421.

Figure 5:
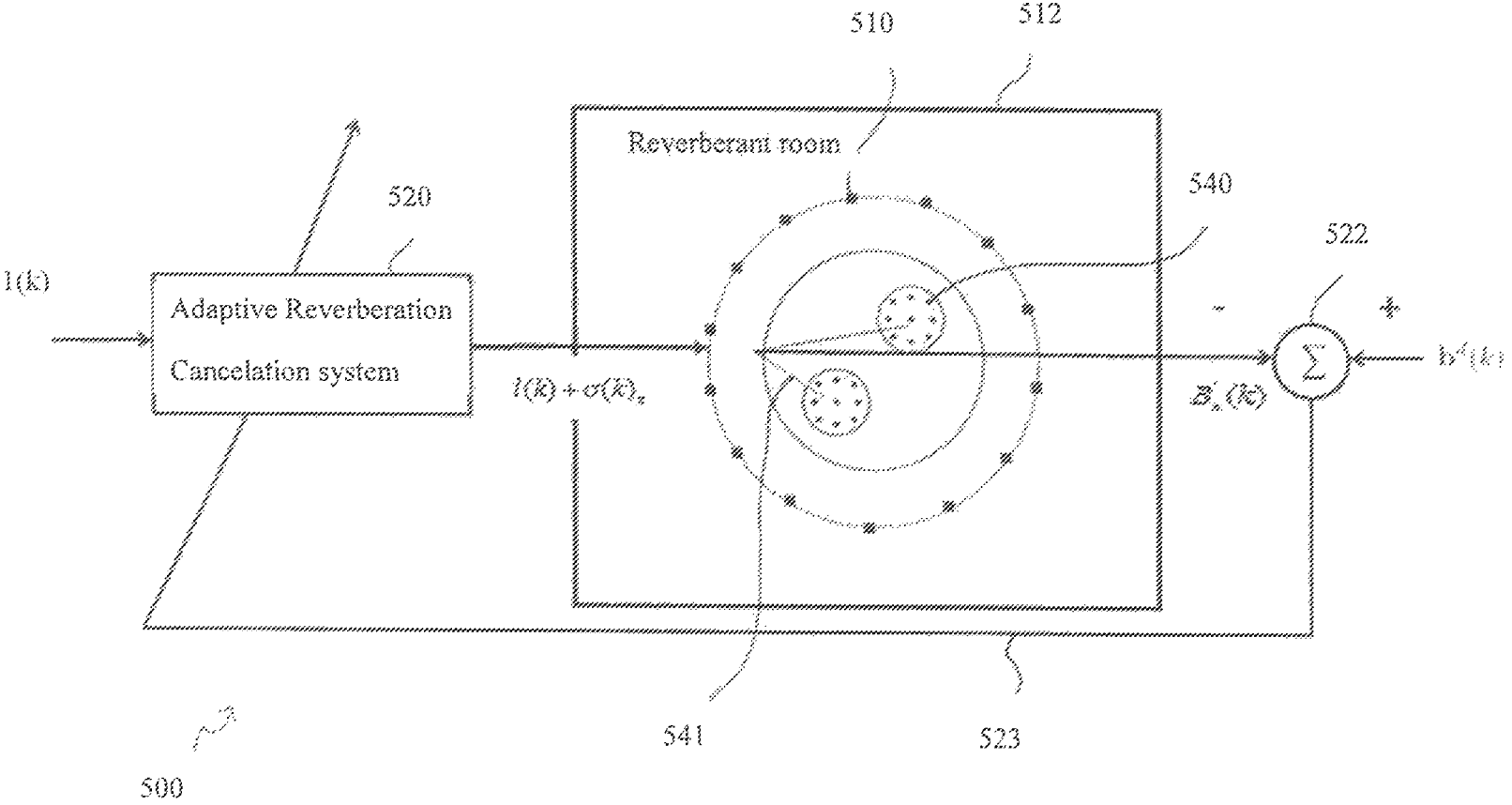
FIG. 5 shows an overview of the operation of the adaptive reverberation cancelation system in accordance with a further embodiment of the present disclosure.

FIG. 5 shows an overview of the operation of a multi zone sound field reproduction system 500 in accordance with a further embodiment of the present disclosure. The multi zone sound field reproduction system 500 comprises an adaptive reverberation cancelation system 520 and a loudspeaker array 510 that is located in a reverberant room 512. The multi zone sound field reproduction system 500 further comprises a summing unit 522. In FIG. 5, the summing unit 522 is shown as a unit that is external to the adaptive reverberation cancelation system 520. However, in other embodiments, the summing unit 522 could be part of the adaptive reverberation cancelation system.

In a $\tau$-th iteration, the adaptive reverberation cancelation system 520 generates an updated drive signal $l(k)+\sigma(k)_\tau$ which drives the plurality of loudspeakers 510. The walls of the reverberant room 512 reflect the generated sound waves.

Microphones 540 measure a plurality of audio signals 541 in the reproduction region and from these measured audio signals a plurality of measured physical coefficients $b_n(k)$ is determined. A difference between the measured physical coefficients $b_n(k)$ and a plurality of desired physical coefficients is formed in the summing unit 522 and fed back to the adaptive reverberation cancelation system 520. Based on the difference, which represents a residual error 523, the adaptive reverberation cancelation system updates the drive signal, which begins a next iteration of the iterative reverberation cancellation process.

Figure 6:
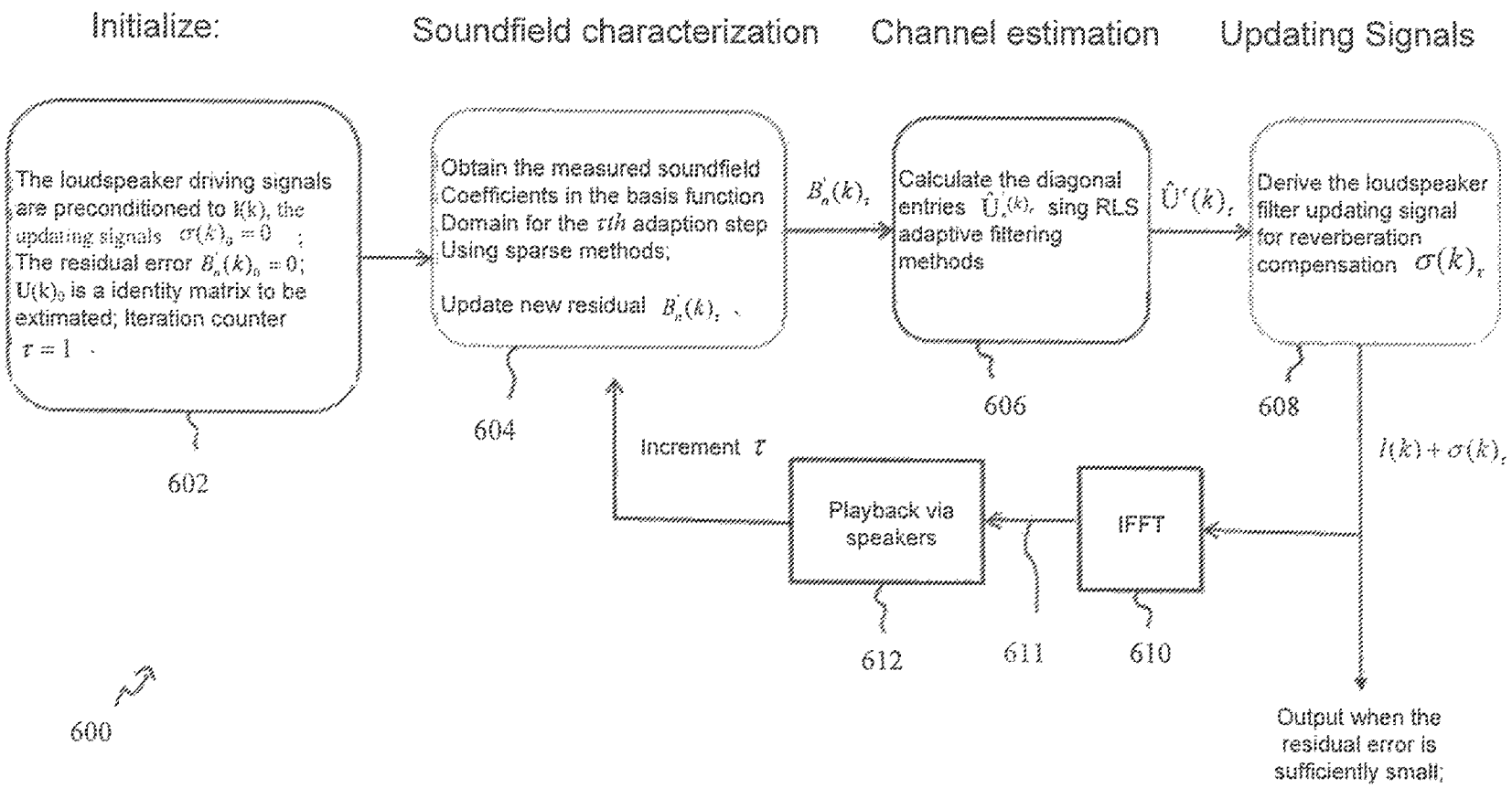
FIG. 6 shows a simplified flow chart of a method for reverberation cancellation in accordance with a further embodiment of the present disclosure.

FIG. 6 shows a flowchart of the adaptive reverberation method 600 in accordance with a further embodiment of the present disclosure.

In a first step 602, the loudspeaker drive signals are preconditioned to l(k), i.e., the initial update is 0.

In a second step 604, a plurality of measured physical coefficients is determined in a basis of physical sound functions, such that a sum of the physical sound functions of the basis, wherein the sum is weighted with the plurality of measured physical coefficients, approximates the one or more measured audio signals.

Based on a difference between the plurality of measured physical coefficients and a plurality of desired physical coefficients, a new residual error is determined.

In a third step 606, diagonal entries of a diagonal matrix $U(k)_\tau$ are determined using RLS adaptive filtering methods.

In a fourth step 608, the array of loudspeakers is driven with the updated plurality of drive signals.

If the residual error is sufficiently small, the method can output the sum of a predefined driving signal (e.g. an input signal times a predefined filter in the frequency domain) l(k) and the update signal $\sigma(k)$. In embodiments of the disclosure, the update signal $\sigma(k)$ can be determined based on an update filter, e.g. by applying the update filter to the predefined driving signal.

In further step 610, an Inverse Fourier Transform is applied to the updated plurality of drive signals $l(k)+\sigma(k)_\tau$ and in further step 612, the Fourier-transformed signals 611 are plaid back with the plurality of speakers. The method then continues in step 604, with an incremented iteration index $\tau$.

In the following, it is described in more detail how a sparse approximation method can be used to calculate $b_n(k)$ from the randomly-placed measurements $v_m(k)$ within the selected zones of interest.

A basic principle of the method is to assume that the reproduced sound field S(x; k) results from only a small number of basis Helmholtz solutions. Based on this assumption, the following lp norm (where 0<p<1) nonconvex optimization problem may be considered:

$$\min_y \|y\|_p^p, \text{ s.t. } \|v-\Phi y\|^2 \le \epsilon, \tag{3}$$

where y is the basis function coefficient set, the dictionary $\Phi$ is an M×N sensing matrix (N>>M) whose columns contain the values of $G_n(x; k)$ at M locations and v is an M×1 observation vector which contains the values of the actual reproduced sound field S(x; k) at M randomly chosen locations within the desired region. The error is related to the he additive complex Gaussian noise level. Let y be a sparse signal, i.e., y has a limited number of non-zero entries at unknown locations. Therefore, the regularized Iteratively Reweighted Least Squares (IRLS) algorithm may be applied to solve equation (3) and derive the optimal estimator $\hat{y}$ that characterizes the reproduced sound field in reverberant environments:

$$\hat{S}(x, k) = \sum_{n=1} \hat{y}_n G_n(x, k), \tag{4}$$

where $\hat{y}$ has only m' (m'≤M) non-zero components and can be used as an estimate of the basis function coefficients $b_n(k)$.

Overall, the calculation of the sound field coefficients $b_n(k)$ may be formulated based on the sound field measurements in (1) in the following matrix form $$b(\bar{k})=TC(k)l(k)=Tv(k), \tag{5}$$

where $b(\bar{k})=[b_1(k), \ldots, b_N(k)]$, T is a transformation matrix (N×M) expressing the relationship of b(k) and v(k), which can be seen as the projection from the sparse measurements onto the subspace spanned by the orthonormal set $\{G_n\}$.

The desired multi zone sound field $S^d(x; k)$ and the actual reproduced sound field in a reverberant room S(x; k) can be characterized by $b^d(k)$ and b(k) that represents the respective coefficient sets of the orthonormal basis function $\{G_n\}$. Note that the coefficients for $S^d(x; k)$ can be derived offline.

Consider the reverberant room channel as a transformation between the reproduced sound field and the desired sound field, which can be further expressed by a linear transformation of the basis function coefficients:

$$b(k)=U(k)b^d(k), \tag{6}$$

where $U(k)=\text{diag}[U_1(k), \ldots, U_N(k)]$ represents the reverberant room effects at the wavenumber k. Note that U(k) may be parametrized with a diagonal structure following the assumption that the couplings between the sound field coefficients with different indices can be neglected in the defined basis function domain.

The room channel transformation U(k) can be estimated in an iterative fashion. $\tilde{b}(k)$ may be defined as the measured sound field coefficients at the microphones after updating the loudspeaker signals. An accurate estimate of the room channel transformation $\hat{U}(k)$ can be achieved if the squared norm of the residual error $\|\tilde{b}(K)-b^d(k)\|^2$ is minimized, which also leads to an accurate matching between the actual reproduced sound field and the desired multi zone sound field over the desired reproduction region. This can be treated as an adaptive filtering problem and U(k) can be estimated actively by using algorithms such as a LMS filter and a RLS filter.

Due to the diagonal structure of U(k), calculating the unknown diagonal entries $U_N(k)$ can be further simplified as a single-tap adaptive filtering problem. Let $\hat{U}(k)_\tau$ be the estimate of U(k) at the τ th adaption step:

$$\hat{U}_n(k)_\tau^H = \hat{U}_n(k)_{\tau-1}^H + \frac{1}{\phi_n^2(\tau)} b_n^d(k)\left(\tilde{b}_n(k)_\tau - b_n^d(k)\right)^H, \tag{7}$$

where $\phi_n^2(\tau)$ is the gain factor $\phi_n^2(\tau)=\lambda\phi_n^2(\tau-1)+|b_n^d(k)|^2$. λ is the forgetting factor. The RLS algorithm may be selected as it provides a fast convergence rate. Therefore, equation (7) can be applied to obtain an iterative estimate of the diagonal elements $U_n(k)$ based on the residual error at the τ th adaption step.

The optimal filter updating signal on the loudspeaker array can be derived based on the active estimate of the room channel transformation. It is designed to minimize the residual error and ensure the estimation convergence. The initial loudspeaker array signals may be preconditioned to reproduce the desired multi zone sound field under free-field assumption. Therefore, the coefficients for the desired sound field $b^d(k)$ can be expressed by replacing C(k) with the direct channel $C^d(k)$ in equation (5):

$$b^d(k)=TC^d(k)l(k). \tag{8}$$

Let $G^d(k)=TC^d(k)$ represent the pre-determined sound field coefficient matrix of the Green's functions for all loudspeakers assuming free-field propagation. Incorporating the room channel model in (6) and the estimator $\hat{U}(k)$:

$$b(k)=\hat{U}(k)G^d(k)l(k). \tag{9}$$

Following (9), the measured sound field coefficients $\tilde{b}_n(k)$ after adding updating signals σ(k) to the loudspeakers can be given by $$\tilde{b}(k)=\hat{U}(k)G^d(k)[l(k)+\sigma(k)]. \tag{10}$$

The difference between the measured and desired sound field coefficients using (8) and (10) may be written as:

$$\tilde{b}(k)-b^d(k)=[\hat{U}(k)-I]G^d(k)l(k)+\hat{U}(k)G^d(k)\sigma(k), \tag{11}$$

where I is an identity matrix.

An efficient reverberation compensation and accurate sound field reproduction can be achieved by finding the optimal loudspeaker filter updating signals σ(k) that minimize $\|\tilde{b}(k)-b^d(k)\|^2$. Therefore, a multi-constraint convex optimization is formulated with the objective of minimizing the error between the measured and desired sound field coefficients, while also guaranteeing the convergence:

$$\min_{\sigma(k)} \left\| G^d(k)\sigma(k) - \left(I - \hat{U}(k)b^d(k)\right)\right\|^2$$

$$s.t.\ \|\sigma(k)_q\|^2 \le N_1 (q=1 \ldots Q).$$

$G^d(k)$ can be calculated offline. The value of $N_1$ is adjustable and it depends how reverberant the room environment is. It can be set to be less or equal to $(1-\beta(k)^2)/N_w$, where β(k) is the reflection coefficients and $N_w$ is the number of walls. Note that the additional constraints on the energy of each of the loudspeaker filter updating signals are applied so that the reverberation effects of $\sigma(k)_q$ are insignificant and can be consistently mitigate the adaptive process, thereby avoiding the active calculation of pseudo-inverse of the reverberation channel matrix. These formulations guarantee the system convergence and lead to less computational complexity and faster convergence than some approaches.

To summarize, in embodiments of the disclosure, the reproduced sound field is described as a weighted series of orthonormal basis functions over the desired reproduction region, which is then used to adaptively equalize the desired multi zone sound field in terms of the basis function coefficients. An adaptive reverberation cancelation system for multi zone sound field reproduction using sparse microphone measurements is proposed. The proposed approach expresses the sound field as a space-frequency orthonormal basis function expansion the desired reproduction region. The reproduced sound field may be considered as a linear transformation of the desired sound field. The adaptive channel estimation process may be introduced using sparse methods to identify these transformations directly in the orthogonal basis function domain and derive the loudspeaker updating signals that compensate the room reverberation and guarantee the convergence of the adaptive estimation in reverberant environments.

Advantages of embodiments of the disclosure include the presented signal processor, sound device and method do not require a prior measurement of the transfer functions of the employed loudspeaker. They can adapt to the alteration of ambient environment condition during the measurement process. The presented signal processor, sound device and method provide an accurate reproduction of the desired sound field under the same hardware provision and environment settings by employing the sparse methods, i.e. the same performance can be achieved using a smaller number of microphone measurements. The presented signal processor, sound device and method show a better convergence behavior to a good reproduction performance, especially in the reverberant rooms that feature low direct-to-reverberant-path power ratios. This is achieved by formulating a novel multi-constraint convex optimization and avoiding the active calculation of pseudo-inverse of the reverberation channel matrix, which guarantee the system convergence. The adaptive reverberation cancelation system rectifies the unwanted reverberation effects based on iterative feedbacks from a small number of microphone measurements, so that the listeners can still enjoy an accurate sound field reproduction even in extreme complex environments (e.g. car chamber). Less computational complexity and faster convergence.

Applications of embodiments of the disclosure include any sound reproduction system or surround sound system using multiple loudspeakers.

In particular, embodiments of the presented disclosure can be applied to TV speaker systems, car entertaining systems, teleconference systems, and/or home cinema system, where personal listening environments for one or multiple listeners is desirable.

The foregoing descriptions are only implementation manners of the present disclosure, the protection of the scope of the present disclosure is not limited to this. Any variations or replacements can be easily made by a person skilled in the art. Therefore, the protection scope of the present disclosure should be subject to the protection scope of the attached claims.

The invention claimed is:

1. A sound device comprising:

a signal processor configured to:

determine from one or more measured audio signals a plurality of measured physical coefficients in a basis of physical sound functions, such that a sum of the physical sound functions weighted with the plurality of measured physical coefficients approximates the one or more measured audio signals, wherein at least half of the plurality of measured physical coefficients are zero;

determine a residual error between the plurality of measured physical coefficients and a plurality of desired physical coefficients;

estimate a transfer function describing a transformation from the plurality of desired physical coefficients to the plurality of measured physical coefficients, based on the determined residual error; and update a plurality of drive signals based on the estimated transfer function.

2. The sound device of claim 1, wherein the signal processor is further configured to, when determining the plurality of measured physical coefficients;

minimize an error measure between the measured audio signals and a linear transformation of the measured physical coefficients; and minimize a number of non-zero entries of the plurality of measured physical coefficients.

3. The sound device of claim 2, wherein the signal processor is further configured to, when minimizing the error measure and minimizing the number of non-zero entries of the plurality of measured physical coefficients, determine a vector b of the plurality of measured physical coefficients according to:

$$b=\text{argmin}_y\|y\|_p^p, \text{ such that } \|v-\Phi y\|^2\leq\in \text{ for } 0\leq p\leq 1,$$

wherein $\|y\|_p$ is a p-norm of a vector y, $\Phi$ is a M×N sensing matrix comprising columns with the physical sound functions, N»M, v is an M×1 observation vector which comprises the one or more measured audio signals corresponding to M locations within the listening area, wherein the signal processor is further configured to randomly chose the M locations.

4. The sound device of claim 1, wherein the basis of physical sound functions is orthogonal with regard to an inner product that for a first vector bi and a second vector bj is representable as:

$$\langle b_i|b_j\rangle=\int_R b_i(x)b_j(x)w(x)dx=\sigma_{ij},$$

wherein R is a reproduction region of a plurality of loudspeakers, w(x) is a weighting function, and $\sigma_{ij}$ is 1 for i=j and 0 otherwise.

5. The sound device of claim 1, wherein the basis of physical sound functions comprises an orthonormal set of physical sound functions obtained from a modified Gram-Schmidt process on plane wave functions corresponding to a plurality of angles.

6. The sound device of claim 1, wherein the transfer function assigns a zero-coupling between a first coefficient and a second coefficient of the basis of physical sound functions, wherein the transfer function is representable as a diagonal matrix U(k).

7. The sound device of claim 6, wherein the signal processor is further configured to, when estimating the transfer function, estimate the diagonal matrix U(k) using a Least Mean Squares filter and/or using a Recursive Least Squares filter.

8. The sound device of claim 7, wherein the signal processor is further configured to, when estimating the diagonal matrix U(k), compute an n-th element of the diagonal matrix U(k) according to $$\hat{U}_n(k)_\tau^H=\hat{U}_n(k)_{\tau-1}^H+\frac{1}{\phi_n^2(\tau)}b_n^d(k)\left(\tilde{b}_n(k)_\tau-b_n^d(k)\right)^H,$$

wherein $\phi_n^2(\tau)$ is a gain factor, defined as $\phi_n^2(\tau)=\lambda\phi_n^2(\tau-1)+|b_n^d(k)|^2$, $\lambda$ is a forgetting factor, $\hat{U}_n(k)_\tau^H$ is an n-th diagonal element of a $\tau$-th iteration of the diagonal matrix, $b_n^d(k)$ is an n-th element of the plurality of desired physical coefficients, and $\tilde{b}_n(k)_\tau$ is an n-th element of a $\tau$-th iteration of the plurality of measured physical coefficients.

9. The sound device of claim 1, wherein the signal processor is further configured to, when updating the plurality of drive signals, compute a drive signal update $\sigma^*$ such that an energy level of the drive signal update $\sigma^*$ is limited with an upper bound, wherein the energy level of the drive signal update $\sigma^*$ is computed as a square value of the drive signal update $\sigma^*$.

10. The sound device of claim 9, wherein the signal processor is further configured to, when updating the plurality of drive signals, compute the drive signal update $\sigma^*$ as:

$$\sigma^*=\underset{\sigma(k)}{\text{argmin}}\left\|G^d(k)\sigma(k)-\left(I-\hat{U}(k)\right)b^d(k)\right\|^2$$

$$\text{s.t. } \|\sigma(k)_q\|^2\leq N_1 \quad q=1\ \ldots\ Q,$$

wherein $G^d(k)$ represents a pre-determined sound field coefficient matrix of Green's functions for a plurality of loudspeakers assuming a free-field propagation, I is an identity matrix, $\hat{U}(k)$ is an estimate of the diagonal matrix, and $N_1$ is a predetermined parameter, wherein $N_1=(1-\beta(k)^2)/N_\omega$, wherein $\beta(k)$ is a reflection coefficient, and $N_\omega$ is a number of walls of a listening area comprising the plurality of loudspeakers.

11. The sound device of claim 1, wherein the signal processor is further configured to perform an initial step of preconditioning a drive signal update $\sigma^*$ to 0 and/or preconditioning a diagonal matrix U(k) to an identity matrix.

12. A method for generating a plurality of drive signals for driving a plurality of loudspeakers to cancel a reverberation effect in a listening area, the method comprising:

driving the plurality of loudspeakers with an initial plurality of drive signals;

measuring one or more audio signals at one or more measurement locations;

determining from the one or more measured audio signals a plurality of measured physical coefficients of in a basis of physical sound functions, such that a sum of the physical sound functions, weighted with the plurality of measured physical coefficients approximates the one or more measured audio signals, wherein at least half of the plurality of measured physical coefficients are zero;

determining a residual error between the plurality of measured physical coefficients and a plurality of desired physical coefficients;

estimating a transfer function from the plurality of desired physical coefficients to the plurality of measured physical coefficients, based on the determined residual error; and updating the initial plurality of drive signals based on the estimated transfer function.

13. The method of claim 12, further comprising:

minimizing an error measure between the measured audio signals and a linear transformation of the measured physical coefficients; and minimizing the number of non-zero entries of the plurality of measured physical coefficients, wherein minimizing the error measure and minimizing the number of non-zero entries of the plurality of measured physical coefficients comprises:

determining a vector b of the plurality of measured physical coefficients according to:

$$b=\text{argmin}_y\|y\|_p^p, \text{ such that } \|v-\Phi y\|^2\leq\in \text{ for } 0\leq p\leq 1,$$

wherein $\|y\|_p$ is a p-norm of a vector y, $\Phi$ is a M×N sensing matrix comprising columns with the physical sound functions, N»M, v is an M×1 observation vector which comprises the one or more measured audio signals corresponding to M locations within the listening area, wherein the signal processor is configured to randomly chose the M locations.

14. The method of claim 12, wherein the basis of physical sound functions is orthogonal with regard to an inner product that for a first vector bi and a second vector bj is representable as:

$$\langle b_i|b_j\rangle=\int_R b_i(x)b_j(x)w(x)dx=\sigma_{ij},$$

wherein R is a reproduction region of the plurality of loudspeakers, w(x) is a weighting function, and $\sigma_{ij}$ is 1 for i=j and 0 otherwise.

15. The method of claim 12, wherein the transfer function assigns a zero-coupling between a first coefficient and a second coefficient of the basis of physical sound functions, wherein the transfer function is representable as a diagonal matrix U(k).

16. The method of claim 15, further comprising, when estimating the diagonal matrix U(k), computing an n-th element of the diagonal matrix U(k) according to:

$$\hat{U}_n(k)_\tau^H = \hat{U}_n(k)_{\tau-1}^H + \frac{1}{\phi_n^2(\tau)} b_n^d(k)\left(\tilde{b}_n(k)_\tau - b_n^d(k)\right)^H,$$

wherein $\phi_n^2(\tau)$ is a gain factor, defined as $\phi_n^2(\tau)=\lambda\phi_n^2(\tau-1)+|b_n^d(k)|^2$, $\lambda$ is a forgetting factor, $\hat{U}(k)_\tau^H$ is an n-th diagonal element of a $\tau$-th iteration of the diagonal matrix, $b_n^d(k)$ is an n-th element of the plurality of desired physical coefficients, and $\tilde{b}_n(k)_\tau$ is an n-th element of a $\tau$-th iteration of the plurality of measured physical coefficients.

17. The method of claim 12, further comprising, when updating the plurality of drive signals, computing a drive signal update $\sigma^*$ such that an energy level of the drive signal update $\sigma^*$ is limited with an upper bound, wherein the energy level of the drive signal update $\sigma^*$ is computed as a square value of the drive signal update $\sigma^*$.

18. The method of claim 17, further comprising, when updating the drive signal, computing the drive signal update $\sigma^*$ as $$\sigma^* = \underset{\sigma(k)}{\text{argmin}}\left\|G^d(k)\sigma(k) - \left(I - \hat{U}(k)\right)b^d(k)\right\|^2$$

$$\text{s.t. } \|\sigma(k)_q\|^2 \leq N_1 q = 1 \ldots Q,$$

wherein $G^d(k)$ represents a pre-determined sound field coefficient matrix of Green's functions for the plurality of loudspeakers assuming a free-field propagation, I is an identity matrix, $\hat{U}(k)$ is an estimate of the diagonal matrix, and $N_1$ is a predetermined parameter, wherein $N_1=(1-\beta(k)^2)/N_\omega$, wherein $\beta(k)$ is a reflection coefficient, and $N_\omega$ is a number of walls of the listening area.

19. A non-transitory computer-readable storage medium comprising instructions that when executed by a signal processor cause the signal processor to:

determine from one or more measured audio signals a plurality of measured physical coefficients in a basis of physical sound functions, such that a sum of the physical sound functions weighted with the plurality of measured physical coefficients approximates the one or more measured audio signals, wherein at least half of the plurality of measured physical coefficients are zero;

determine a residual error between the plurality of measured physical coefficients and a plurality of desired physical coefficients;

estimate a transfer function describing a transformation from the plurality of desired physical coefficients to the plurality of measured physical coefficients, based on the determined residual error; and update a plurality of drive signals based on the estimated transfer function.

* * * * *